US005906721A

United States Patent [19]

Bojkov et al.

[11] Patent Number: 5,906,721

[45] Date of Patent: May 25, 1999

[54] COMPOSITION AND METHOD FOR PREPARING PHOSPHOR FILMS EXHIBITING DECREASED COULOMBIC AGING

[75] Inventors: Christo Pavel Bojkov; Leif Goran Fredin, both of Austin; Nalin Kumar, Canyon Lake; Howard Khan Schmidt, Houston, all of Tex.

[73] Assignee: SI Diamond Technology, Inc., Austin, Tex.

[21] Appl. No.: 08/958,071

[22] Filed: Oct. 27, 1997

Related U.S. Application Data

[63] Continuation of application No. 08/622,307, Mar. 27, 1996, Pat. No. 5,853,554, which is a continuation-in-part of application No. 08/382,319, Feb. 1, 1995, abandoned.

[51] Int. Cl.[6] ..... C25D 13/02

[52] U.S. Cl. ..... 204/491; 204/490; 252/301.4 R; 252/301.6 S; 252/301.4 S

[58] Field of Search ..... 204/490, 491; 252/301.4 R, 301.6 S, 301.4 S

[56] References Cited

U.S. PATENT DOCUMENTS

| | | | |
|---|---|---|---|
| 3,554,889 | 1/1971 | Hyman et al. | 204/481 |
| 3,681,222 | 8/1972 | Gupton, Jr. | 204/481 |
| 3,681,223 | 8/1972 | Guptol | 204/485 |
| 3,714,011 | 1/1973 | Grosso et al. | 204/481 |
| 3,898,146 | 8/1975 | Rehkopf et al. | 204/507 |
| 4,684,540 | 8/1987 | Schulze | 427/71 |
| 4,891,110 | 1/1990 | Libman et al. | 204/490 |
| 4,892,757 | 1/1990 | Kasenga et al. | 252/301.6 F |
| 4,956,202 | 9/1990 | Kasenga et al. | 252/301.6 F |
| 5,124,558 | 6/1992 | Soltani et al. | 250/484.4 |
| 5,204,021 | 4/1993 | Dole | 252/301.4 H |

*Primary Examiner*—Kishor Mayekar
*Attorney, Agent, or Firm*—Winstead Sechrest & Minick P.C.

[57] ABSTRACT

Phosphor screens are disclosed that exhibit decreased Coulombic aging and/or lower threshold voltages. The phosphor compositions and electrochemical methods for making those screens are also disclosed.

13 Claims, 7 Drawing Sheets

COMPOSITION AND METHOD FOR PREPARING PHOSPHOR FILMS EXHIBITING DECREASED COULOMBIC AGING

REFERENCE TO RELATED PATENT APPLICATIONS

This is a continuation of application Ser. No. 08/622,307 filed Mar. 27, 1996 entitled "Composition and Method for Preparing Phosphor Films Exhibiting Decreased Coulombic Aging", now U.S. Pat. No. 5,853,554, which is a continuation-in-part of U.S. application Ser. No. 08/382,319 filed Feb. 1, 1995 and entitled "ELECTROCHEMICAL DOPING OF PHOSPHORS VIA CODEPOSITION WITH INORGANIC CATIONS", now abandoned.

FIELD OF THE INVENTION

This invention relates generally to phosphor films that exhibit decreased Coulombic aging and/or lower threshold voltages and to the phosphor compositions and methods employed in making those phosphor films. More particularly, this invention relates to a method for preparing phosphor films from powder luminescent materials (phosphors) that exhibit high conductivity, luminous efficiency and an increased life expectancy via electrochemical codeposition of charged phosphors and inorganic cations onto a conductive substrate, as well as novel powder luminescent mixtures with a high yield of secondary electron emission.

BACKGROUND OF THE INVENTION

The use of cathodoluminescent materials (phosphors), substances that transform energy into light, has become ubiquitous in consumer electronic displays, including the wrist watch, electronic equipment status displays, and laptop computers. Phosphor films are also important in defense applications, ranging from high definition table top map displays to helmet-mounted and "headsup" displays.

One of the most common uses for phosphor films is in computer screens. A major limitation in the use of phosphor films is that their luminescence degrades over time. The mechanism(s) for this degradation is poorly understood, but the degree of degradation is related to the "Coulombic aging" of the phosphor. "Coulombic aging" is the current multiplied by time and expressed as Coulombs of charge per unit area.

The most widely used phosphors in the manufacture of computer screens are zinc sulfides because their quantum efficiency is known to be the highest, about 22%, compared to some other oxysulfides or silicate phosphors which have a quantum efficiency of about 2–12%. A major problem with the zinc sulfide phosphors, however, is their Coulombic aging which leads to a loss of efficiency and brightness with use. Zinc sulfide phosphors lose about half of their brightness, or 50% of their initial efficiency, after only 30–50 Coulombs/cm$^2$ charge loading. Since 1 Coulomb/cm$^2$ corresponds to about 250 hours of cathode ray tube (CRT) phosphor screen use, the life expectancy of a zinc sulfide phosphor screen typically does not exceed 12,500 hours of operational life. Zinc sulfides, being the standard cathodoluminescent material used in phosphor screens, have dictated the commercial requirement that CRTs have an operational life span of 10,000 hours.

The Coulombic aging of phosphors has become increasingly critical for the computer industry with the development of the Flat Panel Display (FPD), which operates at higher current densities than CRTs and therefore has an even shorter life span than CRTs. For example, the operational voltage for FPDs range from 100 V to 1,000 V and require higher current densities to achieve the same power loading. Under these operational conditions, the phosphors (especially the more efficient sulfide and oxysulfide phosphors) quickly degrade due to Coulombic aging and saturation. Thus, extending the life span of the FPDs, which could lead to the commercial realization of full-color FPDs, would require the development of phosphors that are not as susceptible to Coulombic aging or could operate at lower current densities.

To date, the operational voltage of FPDs has been limited by the physical and chemical characteristics of the phosphors used. Commercially available phosphors have a high threshold voltage typically ranging from about 100 to 120 electron volts (eV). Since currently available CRTs and FPDs use phosphors having a high threshold voltage, the operation of those display devices is highly power consumptive.

Thus, there is a pressing need for phosphor films that exhibit decreased Coulombic aging and/or lower threshold voltages.

SUMMARY OF THE INVENTION

The disclosed phosphor compositions and electrochemical methods can be utilized to make phosphor films and screens that overcome the above-noted disadvantages and drawbacks characteristic of the prior art.

In accordance with one aspect of the invention, there is provided a method for producing a phosphor screen comprising a glass substrate coated with a conductive material and a phosphor film, where the phosphor film comprises from about 85 to about 98 weight percent (w %) of phosphor and about 2 to about 15 w % of an oxidized inorganic cation.

A method for producing the phosphor screen described above comprises the steps of preparing a phosphor deposition composition (the solution comprising an organic solvent, a charged phosphor, and an inorganic salt, depositing the charged phosphor and a cation (the cation generated by the dissociation of the inorganic salt in the solution) onto a conductive substrate, and curing the phosphor screen on which the phosphor film has been deposited.

An alternative method for producing the phosphor screen described above comprises the steps of depositing a charged phosphor onto a conductive substrate, depositing a cation onto the deposited phosphor film, and curing the phosphor screen on which the phosphor and cation have been deposited.

Other novel features and advantages of the present invention will become apparent from the following detailed description of the invention.

Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the claims of the invention.

BRIEF DESCRIPTION OF THE DRAWINGS

Numerous objects, features and advantages of the present invention will be readily apparent to those of ordinary skill in the art upon reading the following disclosure in conjunction with the accompanying drawings, in which.

DETAILED DESCRIPTION OF THE PREFERRED EMBODIMENTS

The present invention relates to phosphor films that exhibit decreased Coulombic aging and/or lower threshold voltages and should lead to new and better display devices that utilize a phosphor film for emission of photons to produce images, such as CRTs and FPDs. The invention also relates to novel phosphor deposition compositions with a high yield of secondary electrons and to methods of making and depositing the components of those deposition compositions onto a substrate.

The present invention changes the characteristics of the currently available phosphor screens by depositing a charged phosphor (a phosphor particle with a first cation absorbed thereon) and a second cation (wherein an oxidative product of the second cation has a secondary electron emission ratio that is greater than 1.0) onto a conductive substrate. It is believed that the altered phosphor lattice comprises oxidation products of the phosphor, the charging cation (i.e., the first cation), and the second cation. These oxidation products are theoretically formed during the curing of the deposited phosphor film in an oxidative environment. The ratio of phosphor to the second cation in the phosphor film of the present invention ranges from about 90 to about 99 weight percent (w %) phosphor and from about 1 to about 10 w % second cation. The phosphor film of the present invention is made by depositing a charged phosphor onto a conductive substrate with the proper ratio of phosphor to second cation and curing the deposited phosphor film by heating the film in the presence of an oxidative agent such as oxygen, chlorine, bromine, or hydrogen sulfide.

Figure 1A:
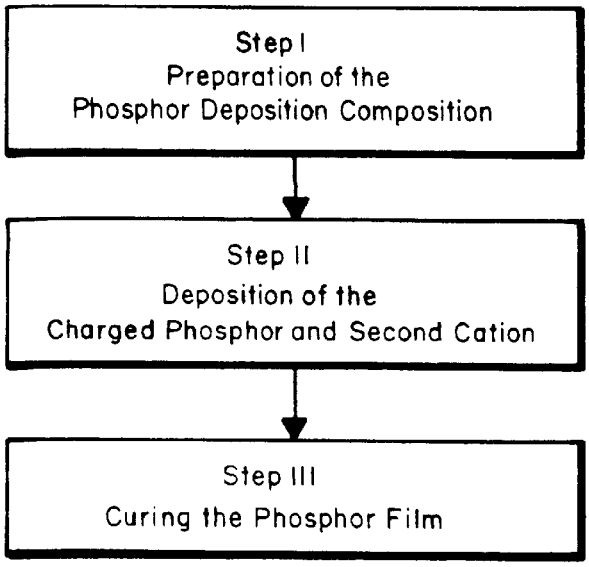
FIG. 1A illustrates the sequential steps for practicing a preferred embodiment of the present invention.

A preferred method of depositing a phosphor film on a substrate to yield a phosphor screen with decreased Coulombic aging and/or lower threshold voltages is by electrochemically depositing a charged phosphor with a second cation as shown in FIG. 1A. Alternative methods of depositing a second cation may also be employed. For example, the second cation may be applied to the phosphor coated substrate by dipping the phosphor coated substrate in a second salt solution, by spraying the phosphor coated substrate with a second salt solution, by electrochemically depositing a second cation on the phosphor coated substrate, or by a variety of other methods.

Referring now to FIG. 1A, the method depicted therein generally comprises three steps. The first step involves the preparation of a phosphor deposition composition, the second step comprises the deposition of the phosphor and second cation on a conductive substrate, and the third step includes the curing of the phosphor film. Each step is described in more detail below.

Step I, of the embodiment depicted in FIG. 1A, comprises the preparation of a phosphor deposition composition. The phosphor deposition composition comprises from about 4 to about 14 w % of a phosphor (typically a commercially available phosphor), from about 0.0001 to about 0.05 w % of a charging salt, and from about 0.05 to about 10 w % of a second salt; wherein the phosphor, charging salt and second salt are dispersed in about 76 to about 95 w % of an organic solvent. The preferred embodiments of the phosphor deposition composition comprise from about 7 to about 12 w % of a phosphor, from about 0.005 to about 0.04 w % of a charging salt, and from about 1 to about 5 w % of a second salt; wherein the phosphor, charging salt and second salt are dispersed in about 82 to about 91 w % of an organic solvent.

Phosphors that are suitable for the present invention are the inorganic salts of the elements zinc, yttrium, aluminum, silicon, and gadolinium. Particularly useful in the present invention are the oxide, sulfide and oxysulfide salts of the elements listed above. Phosphor mixtures may be used in the present invention, although preferred embodiments of the phosphor deposition composition include only one phosphor.

Phosphors, such as zinc sulfide, are often mixed with one or more activators and fired at 900° to 1200° C. to produce a new crystal lattice from the phosphor and activator. Commercially available phosphors incorporate a wide range of phosphor activators, which determine the color of the phosphor. Phosphors are commonly designated by a term indicating the symbol of the host crystal being listed first and the symbol of the activator being listed after a colon indicating variable nonstoichiometric proportions. For example, ZnS:Cu is a green phosphor with a zinc sulfide host crystal, or base material, and a copper activator, or phosphorogen. Similarly ZnS:Ag is a blue phosphor with a zinc sulfide host crystal and a silver activator. The green color of the ZnS:Cu phosphor and the blue color of the ZnS:Ag phosphor are determined by the copper and silver activators respectively. Many of the commercially available phosphors, such as ZnS:Cu or ZnS:Ag, can be used as the phosphor component of the phosphor deposition composition.

The phosphor powder comprises from about 4 to about 14 w % of the phosphor deposition composition and preferably comprises from about 7 to about 12 w %. Exemplary phosphors include ZnO:Zn (a green phosphor); ZnS:Cu,Al (a green phosphor); ZnS:Ag (a blue phosphor); and $Y_2O_2S$:Eu (a red phosphor) with the zinc sulfide phosphors being the preferred phosphors. The phosphors that are used in the present invention are in powder form with particle sizes ranging from 1 to 20 microns. However, smaller phosphor particles may be used. Preferred phosphor powders used in the phosphor deposition composition should be very pure (preferably about 99.999%) and exhibit low solubility in organic alkanol solutions.

Figure 2:
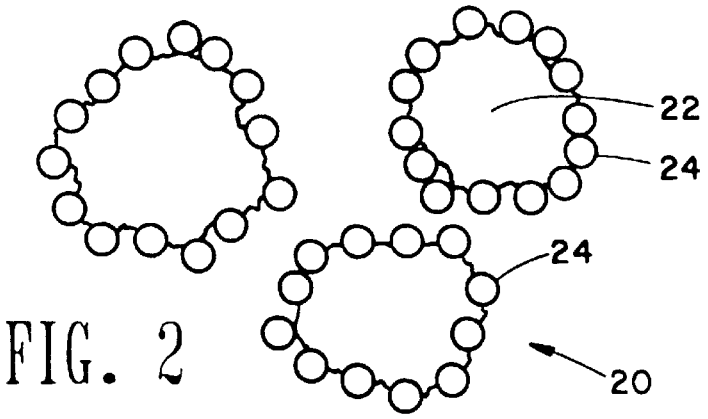
FIG. 2 illustrates the theoretical structure of phosphor particles charged via the surface adsorption of inorganic cations.

Another ingredient of the phosphor deposition composition is a charging salt. The charging salts used to charge the phosphor particles should have a solubility from about 1 to 100 gram ion/liter in the organic solvent used for phosphor deposition in order to ensure the dissociation of the salt into its cation and anion components. The cation dissociated from the charging salt is theoretically adsorbed to the surface of the phosphor particle to form the charged phosphor as shown in FIG. 2. Preferred charging salts have a trivalent or tetravalent cation that will provide good mobility for the phosphor particle in an electric field and will allow the charged phosphor to be deposited at low voltage. In contrast, a bivalent cation (such as $Mg^{++}$) adsorbed to a phosphor particle will typically not deposit well at low voltages such as 50 V or less. Furthermore, it is preferred to limit the amount of charging salt in the phosphor deposition composition to that quantity of charging salt that is necessary to charge the phosphor particles.

Lanthanum and aluminum salts, or mixtures thereof, are the preferred charging salts (e.g., $La(NO_3)_3$, $La_2O_3$, and $Al(NO_3)_3$). In the preparation of the phosphor deposition composition, the charging salt is preferably added to the phosphor suspended in the previously described organic solvent in concentrations ranging from 0.0001 to 0.01 M. A preferred embodiment of the present invention set forth in Example 2, includes $5\times10^{-4}$ M $La(NO_3)_3$ as the charging salt. Generally, the charging salt will comprise from about 0.0001 to about 0.05% w % of the phosphor deposition composition and will preferably comprise from about 0.005 to about 0.04 w % of the composition.

The phosphor deposition composition further comprises a second inorganic salt that is different from the charging salt (the second salt). The cations and anions of suitable second salts should be dissociable in the organic solvent used for phosphor deposition. For example, the second salt selected to be added to a charged phosphor in ethanol or isopropanol should have a solubility from about 1 to about 100 gram ion/liter in the solvent used and should have a dissociation constant in the range of about 0.1 to 100. The second salt may be added to the charged phosphor suspension as either a powder or as an alkanoic solution. The second salt is added to the phosphor after the charging salt has had time to adsorb to the phosphor particles and will not precipitate the phosphor. Preferred second salts are divalent or trivalent, depending on the charging salt used, and will not easily displace the charging cation from the phosphor particle.

Suitable second salts have a cation that can form an oxidative product having a secondary electron emission ratio that is greater than 1.0 and is preferably greater than 2. The secondary electron emission ratio is the average number of secondary electrons emitted from a bombarded material for every incident primary electron. Such salts include the nitrate, sulfate and oxide salts of the elements: Mg, Cu, Ag, Au, Cr, Pb, Ce, Sn, In, Zn, Co, Cr, Zr, Al, Cs, and Mo, and mixtures thereof Preferred second salts are the nitrate, sulfate and oxide salts of metallic elements such as Mg, Cu, In, Sn, Zn and Ag. Exemplary second salts are $Cu(NO_3)_2\times 6H_2O$ (see Example 2 below), $AgNO_3$ (see Example 4 below), $Mg(NO_3)_2\times6H_2O$ (see Example 3 below), ZnO (see Example 6 below), $SnO_2$ and $In_2O_3$. Highly purified preparations of second salts should be added to the phosphor deposition composition at from about 0.001 to about 0.1 M concentrations. The second salt comprises from about 0.05 to about 10 w % of the phosphor deposition composition. In preferred embodiments of the invention the second salt will comprise from about 1 to about 5 w % of the phosphor deposition composition.

The phosphor deposition composition ingredients described above are dispersed in an organic solvent such as one of the lower alkanols, with one to five carbons, or a mixture of two or more of the lower alkanols. A lower alkanol from about 76 to about 95 w % is used in the present invention and, depending on the alkanol used, is preferably used at from about 82 to about 91 w %. Preferred solvents included in the phosphor deposition composition have a boiling point between 55° and 99° C., a dielectric constant from about 2 to 5.5 at 25° C., and a conductivity of 0.5 to $3\times10^{-6}$ Siemens/cm (or 0.5 to 3 $\mu$S/cm). Exemplary solvents include isopropanol and ethanol.

The components of the phosphor deposition composition may be combined by suspending a phosphor in a solvent, charging the suspended phosphor and then adding a second salt to the charged phosphor as described in Example 2.

In a preferred embodiment of the invention, the phosphor powder (preferably sieved to remove large aggregates) is added to an agitated organic solvent. In a preferred embodiment the charging salt is added to the phosphor powder dispersed in the solvent and the mixture continues to be agitated. However, if the phosphor particles can be easily dispersed in the organic solvent without the formation of agglomerates then the charging salt may be added to the solvent before the phosphor or at the same time as the phosphor is added. The mixture of phosphor and charging salt in the organic solvent is theoretically agitated until the cation dissociated from the charging salt is adsorbed to the surface of the phosphor particle as shown in FIG. 2. Upon formation of the hypothetical charged phosphor particles 20, or adsorption of the cation 24 to the surface of the phosphor particle 22, the charged phosphor particles 20 are treated, preferably by ultrasound, to break up large phosphor particle agglomerates.

The conductivity of the charged phosphor solution may be adjusted to from about 1 to about 100 $\mu$S/cm, preferably from about 5 to about 10 $\mu$S/cm, before the second salt is added to form the phosphor deposition composition. The phosphor deposition composition continues to be agitated and treated, as needed, to disrupt phosphor particle agglomerates in the solution.

Step II of the embodiment depicted in FIG. 1A comprises the deposition of the phosphor deposition composition. The preferred deposition process is to electrochemically codeposit the charged phosphor and the second cation onto a conductive substrate.

Figure 1B:
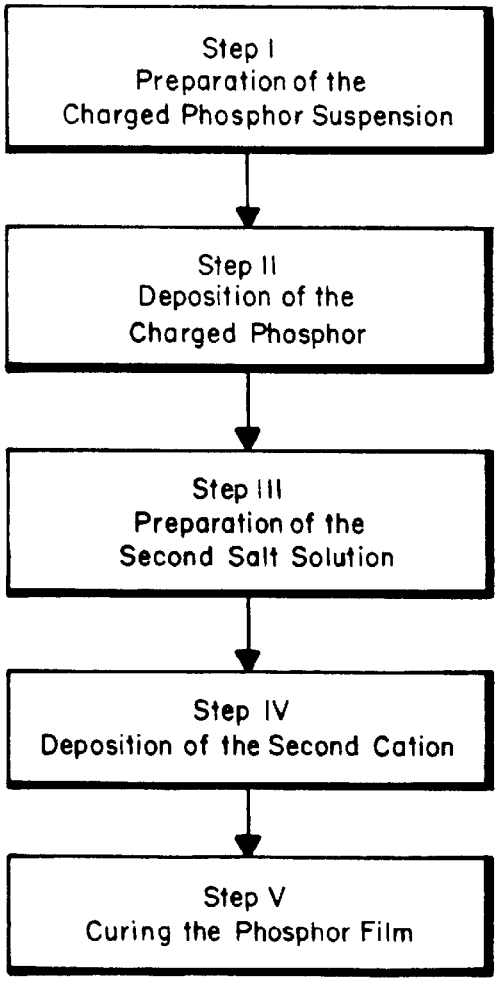
FIG. 1B illustrates the sequential steps of an alternative embodiment of the present invention.

Alternatively, the charged phosphor may be prepared and deposited on the substrate by itself. Then a solution of the second salt is prepared and deposited onto the phosphor coated substrate as indicated in FIG. 1B.

Figure 3:
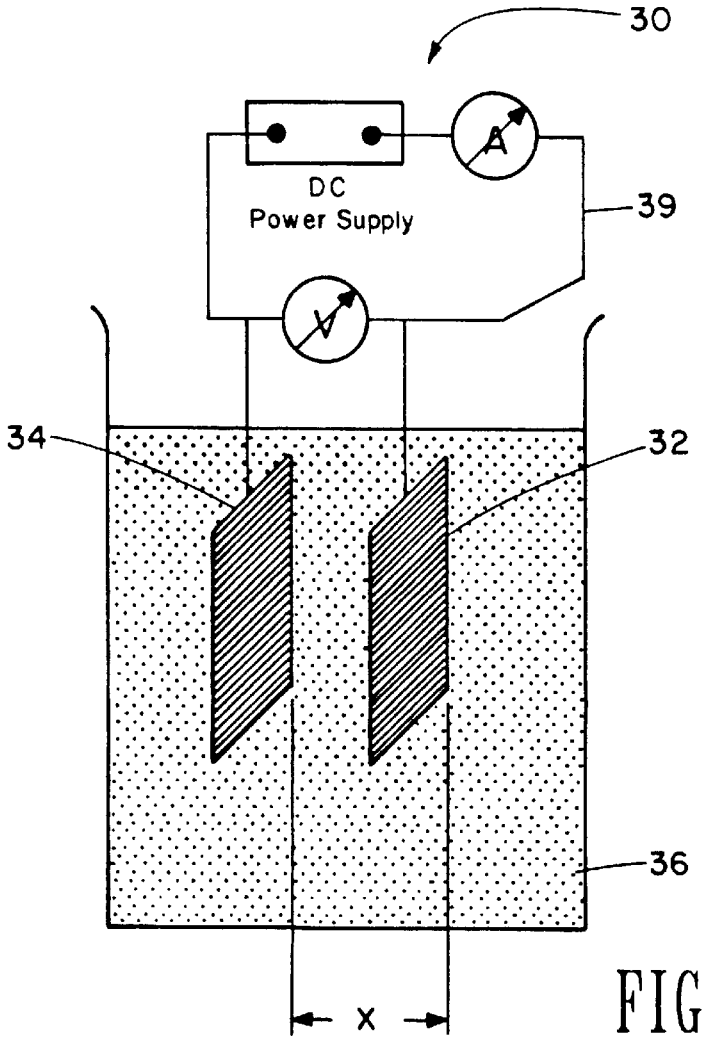
FIG. 3 illustrates schematically a preferred embodiment of a deposition apparatus useful for the electrochemical deposition of a charged phosphor and inorganic cation.

A preferred electrochemical deposition apparatus 30, illustrated in FIG. 3, has a Ni, Fe or Pt anode 32 and a cathode 34 consisting of a conductive substrate. One embodiment of a conductive substrate used for a cathode in the electrochemical deposition apparatus is a glass plate coated on one side with a thin layer of indium tin oxide (ITO).

Step III, of the embodiment depicted in FIG. 1A, comprises the curing of the deposited phosphor film. This is done by heating the phosphor film in the presence of an oxidative agent such as oxygen, chlorine, bromine, or hydrogen sulfide. These compounds will react with the cations that have been deposited onto the conductive substrate. In a preferred embodiment, the phosphor film is placed in a baking container in an oven and the oven is flushed with an oxidizing gas. Preferred gases comprise from about 20 to about 60% oxygen and about 40 to about 80% nitrogen or one of the inert (or noble) gases of Group O of the periodic table of elements. A preferred embodiment described in Example 1, flushes the oven with a 50/50 mixture of oxygen and nitrogen. However, the atmosphere that one selects to cure the phosphor film will be determined by the oxidative products that one desires to produce.

Phosphor screens manufactured by the present invention have a phosphor film that theoretically consists of phosphor particles interspersed or coated with an oxidized metallic cation that has a secondary electronic emission ratio that is greater than 1.0. The addition of the second cation to the deposited phosphor film does not necessarily change the resolution of the resulting phosphor screen nor does it necessarily change the color characteristics of the phosphor. However, the oxidative products having a secondary electronic emission ratio that is greater than 1.0 can theoretically enhance the effectiveness of the electrons that impinge the phosphor film.

Furthermore, the addition of a second cation in the deposited phosphor film can result in phosphor screens with a decreased surface resistance, or an increased electroconductivity (e.g., from about 80 to 100 ohms/cm to about 40 to 45 ohms/cm), and an increased thermal conductivity (e.g., 0.042 Cal/sec×cm$^2$×C. °/cm to 0.066 Cal/sec×Cm$^2$×C. °/cm). This increased thermal conductivity of the phosphor screens may also help to explain the decrease in Coulombic aging.

Figure 4:
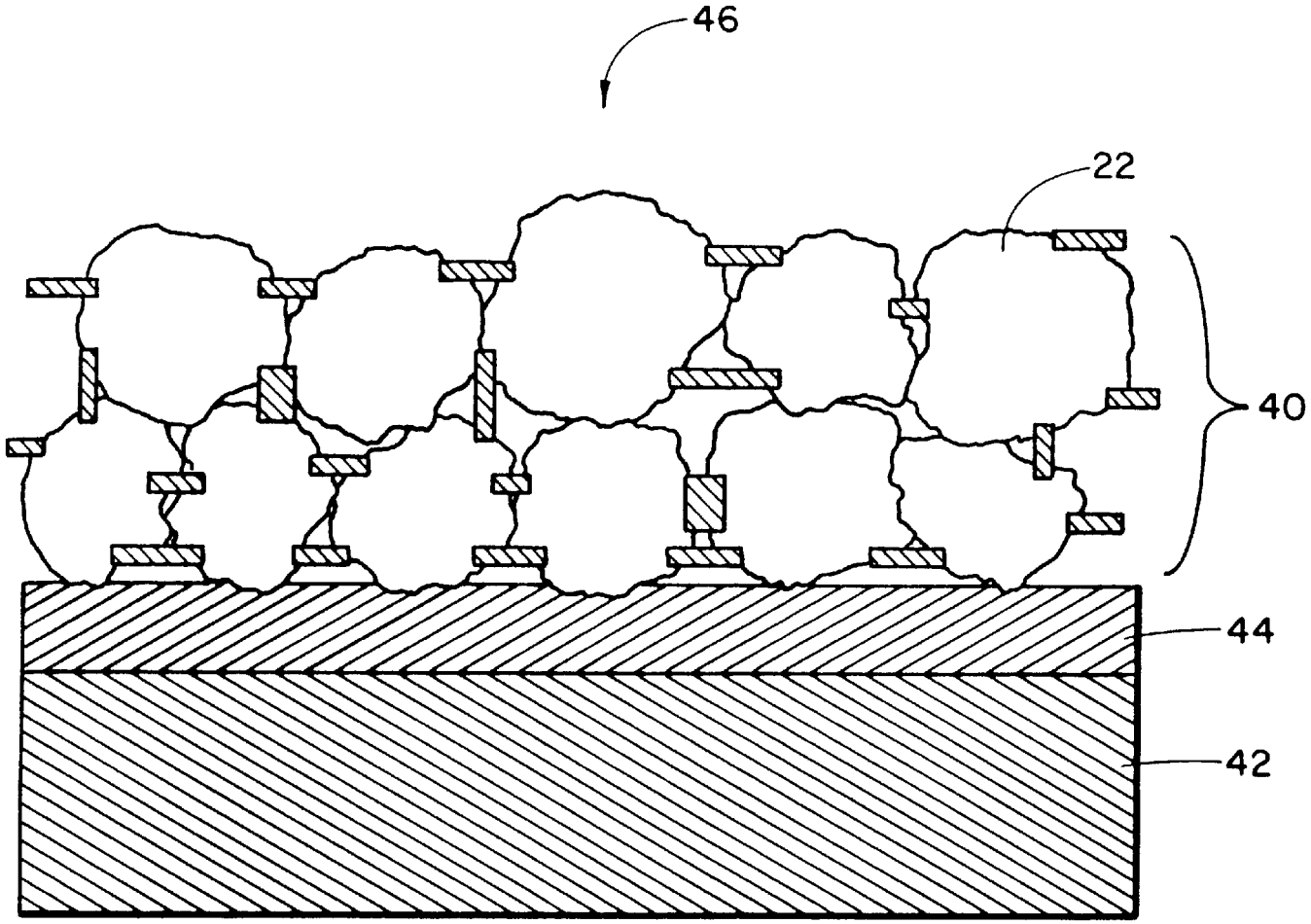
FIG. 4 illustrates schematically a preferred embodiment of a phosphor screen.

Phosphor screens manufactured as described herein may be used in a number of ways. For example, phosphor screen 46, as illustrated in FIG. 4, may be used as an anode plate in a display device such as device 50 shown in FIG. 5. One embodiment of phosphor screen 46 comprises glass plate 42, ITO layer 44 (which serves as a conductive layer), and deposited phosphor film 40. The cathode assembly 52 of the display device is comprised of a substrate 57 (preferably glass), a conductive layer 55, a resistive layer 53, and low work function emitting material 54. The conductive layer 55, resistive layer 53 and emitting material 54 comprise the cathode strip 56, which may be addressable by driver circuitry (not shown). In display device 50, space 59 between emitting material 54 and phosphor film 40 is kept uniform by spacers 51 and 58.

Display device 50 illustrates a diode structure field emission device providing the capability of being matrix addressable through conductive layers 55 and 44. As a result, the portion of device 50 shown may be a pixel location within a flat panel display, which is addressable by driver circuitry driving the display. Further discussion of the display device 50 may be found in co-pending U.S. patent application Ser. Nos. 08/304,918, 07/995,846 and 07/993,863, which are hereby incorporated by reference herein.

Figure 5:
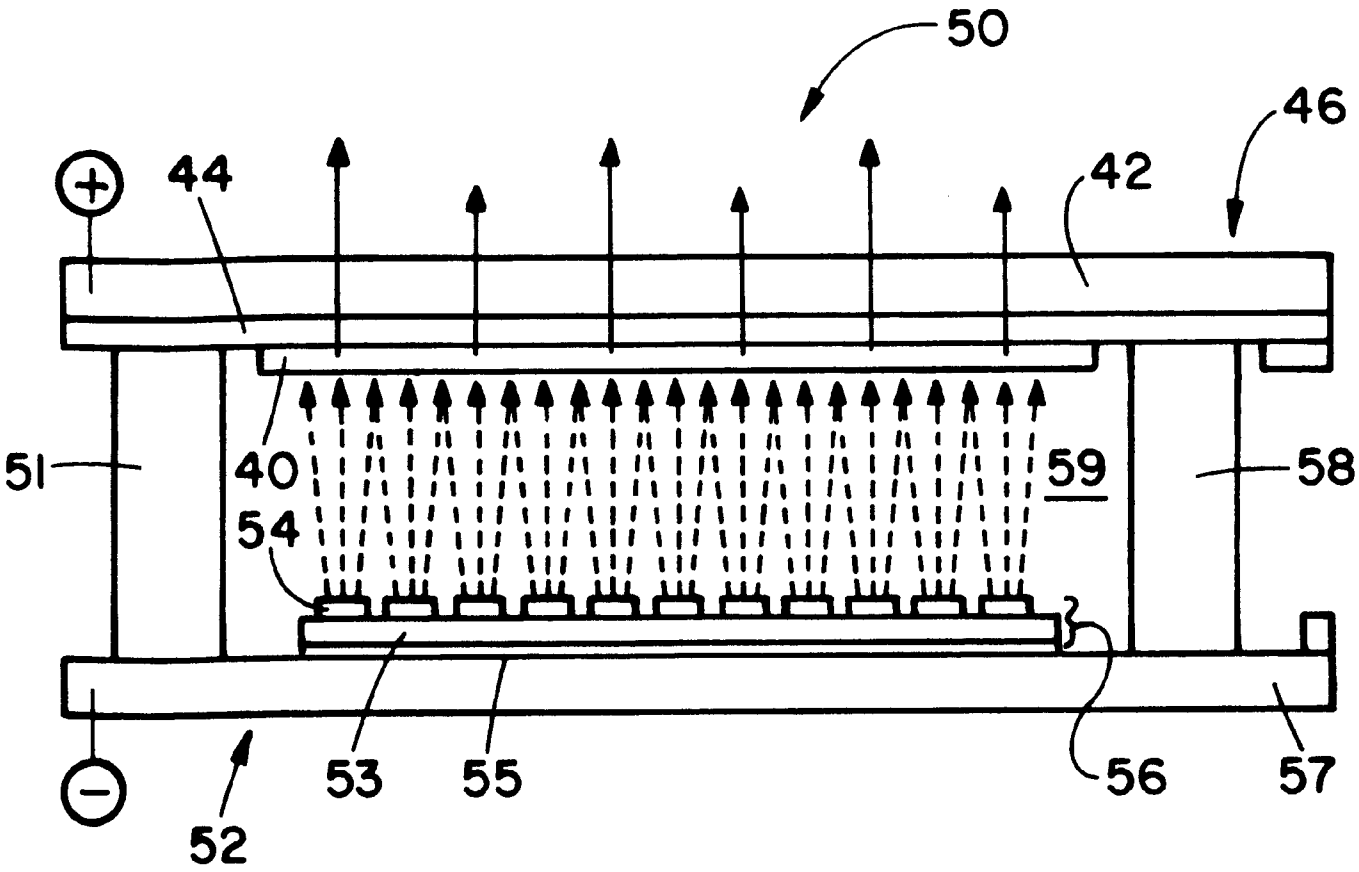
FIG. 5 illustrates a portion of a flat panel display device implementing a phosphor film deposited in a manner set forth herein.
Figure 6:
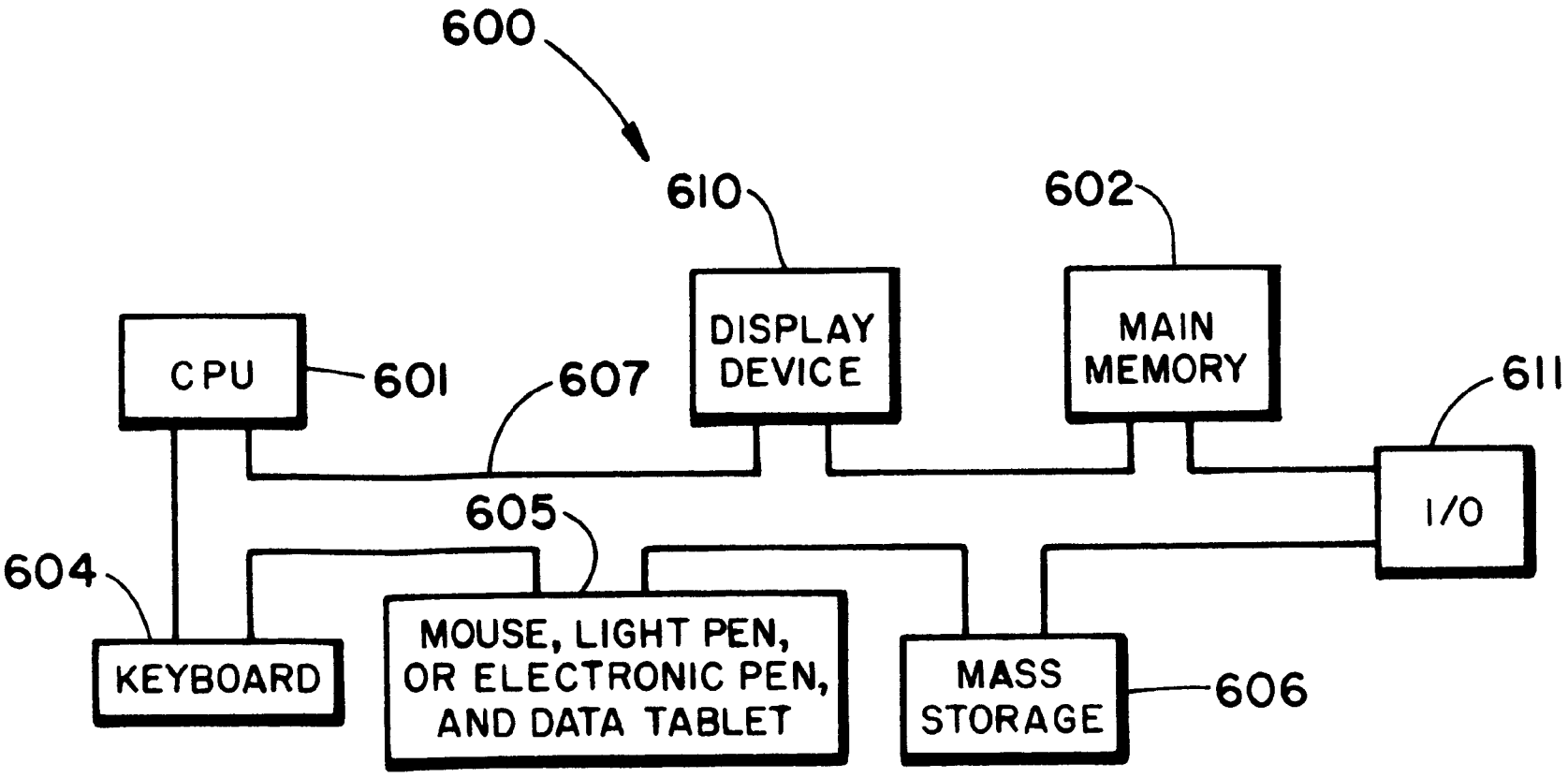
FIG. 6 illustrates a data processing system with a display device incorporating the present invention.

Referring next to FIG. 6, there is illustrated data processing system 600 employing display device 610 produced in accordance with the present invention. Display device 610 is coupled to microprocessor ("CPU") 601, keyboard 604, input devices 605, mass storage 606, input/output ports 611, and main memory 602 through bus 607. All of the aforementioned portions of system 600 may consist of well-known and commercially available devices performing their respective functions within a typical data processing system. Display device 610 may be a cathode ray tube, a liquid crystal display, a field emission display (such as illustrated in FIG. 5), or any other type of display that utilizes a phosphor layer for emission of photons to produce images on a display.

The present invention is further defined by reference to the following examples, which are intended to be illustrative and not limiting.

EXAMPLE 1

Preparation of Phosphor Screens Without a Second Cation

I. Preparation of the Phosphor Deposition Composition (per 100 ml.)

In a clean container, one gram of a commercially available phosphor, such as ZnS:Cu,Al powder, is suspended in isopropanol. The phosphor powder (preferably sieved through about a 250 mesh screen) is slowly added to approximately 100 ml of continuously stirred isopropanol. Then 0.05 gm $La(NO_3)_3 \times 6H_2O$, which is a $5\times10^{-4}$ M concentration of a 99.99% pure salt, is added to the stirred phosphor suspension. This preparation is continuously stirred for 30 min with a magnetic stirrer to allow the adsorption of the disassociated cation ($La^{+3}$) onto the surface of the phosphor particles. Upon formation of the $La^{+3}$-charged phosphor particles, the charged phosphor particles are ultrasonically treated to break up phosphor particle agglomerates. Ultrasonic treatment is done by placing the mixture in an ultrasound bath and subjecting the mixture to a fairly intense level of ultrasound (from about 40 to about 60 watts) for approximately 30 min as judged from the dispersion of the phosphor agglomerates.

The conductivity of the charged phosphor suspension is measured on a carefully standardized conductivity meter. The charged phosphor suspension conductivity is adjusted to fall between 5 and 10 $\mu$S/cm. If the conductivity of the suspension is less than 5 $\mu$S/cm, additional $La(NO_3)_3$ is added. If the conductivity of the suspension is greater than 10 $\mu$S/cm, isopropanol is added.

II. Deposition of the Phosphor

The electrochemical deposition apparatus 30 is prepared by carefully cleaning the anode 32, the cathode 34, and the deposition container 36. A preferred deposition apparatus has an anode, made of Ni metal foil or mesh with a surface area of about 25 to 30 cm$^2$, and a cathode, consisting of a soda lime glass plate coated on one side with a thin (approximately 1,000 angstroms) layer of indium tin oxide (ITO). Both the anode and the cathode are ultrasonically cleaned in a 50%/50% water/methanol solution for 15 min and then consecutively rinsed thoroughly in distilled water, acetone and isopropanol. The deposition container is also cleaned and a teflon stir bar placed within. The phosphor deposition composition is poured into the deposition container 36 and gently stirred by way of a magnetic stirring device. The cathode 34 and anode 32 are then mounted in their appropriate connectors and positioned within the deposition apparatus in a substantially parallel position to each other at a distance x, preferably about one inch, from each other. The electrodes are then connected to a DC power supply 39; the anode 32 is connected to the (+) plate and the cathode 34 is connected to the (−) plate.

Once the deposition apparatus 30 has been prepared, the agitation of the phosphor deposition composition is temporarily stopped to allow large phosphor particle agglomerates to settle out of the solution before deposition begins. The voltage or current density settings of the deposition apparatus 30 are set. Preferably a voltage setting of about 200 to 250 V is used, or a current density of about 1 to 8 mA/cm$^2$. A preferred embodiment of the present invention deposits the phosphor deposition composition using a current density between 3 and 5 mA/cm$^2$. The voltage or current is activated for the desired period of time. In the preferred embodiment, a ten second deposition hypothetically results in a deposited phosphor film 40 that is about two phosphor particles 22 thick; whereas, a sixty second deposition will yield a deposited phosphor film 40 that is about four or five phosphor particles 22 thick. Once the desired phosphor deposition is complete, the voltage or current is turned off and the cathode 34 (or phosphor screen 46) is removed from the deposition apparatus 30. The resultant phosphor screen 46 includes glass plate 42, ITO layer 44, and deposited phosphor film 40. If needed, the phosphor screen 46 is gently washed by spraying isopropanol along the top edge of the phosphor screen and allowing the isopropanol to wash down over the deposited phosphor film to remove any nonadherent phosphor particles. The washed phosphor screen is then dried in a vertical position in a clean room under a stream of nitrogen flowing at about 20 to 30 psi pressure.

III. Curing the Phosphor Screen

The coated phosphor screen is placed in a glass baking container in an oven at atmospheric pressure. The oven is flushed with an oxidative atmosphere. A preferred atmosphere is an oxygen/nitrogen gas mixture (50% oxygen and 50% nitrogen) flowing at 5 to 6 liters/min. The oven is then heated to at least 350° C. Depending on the temperature of the oven, the phosphor screen is retained in the oven from about 2 min (for an oven temperature of about 1200° C.) to about one to three hours (for an oven temperature of about 350° C.). Preferably, the oven is gradually heated at a rate of about 20° C./min up to 450° C. Once the oven reaches 450° C., that temperature is retained for about 1 hour. Once the phosphor screen has been baked for the desired time at the desired temperature the oven is turned off and allowed to cool down to room temperature. Once room temperature is achieved, the oxygen/nitrogen gas is turned off and the phosphor screen is removed from the oven to a clean container to await assembly into a display device, such as the FPD device 50 illustrated in FIG. 5.

Steps I to III should be done in a low humidity environment in an area (clean room) having 100 or fewer particles per cubic meter volume.

Figure 7:
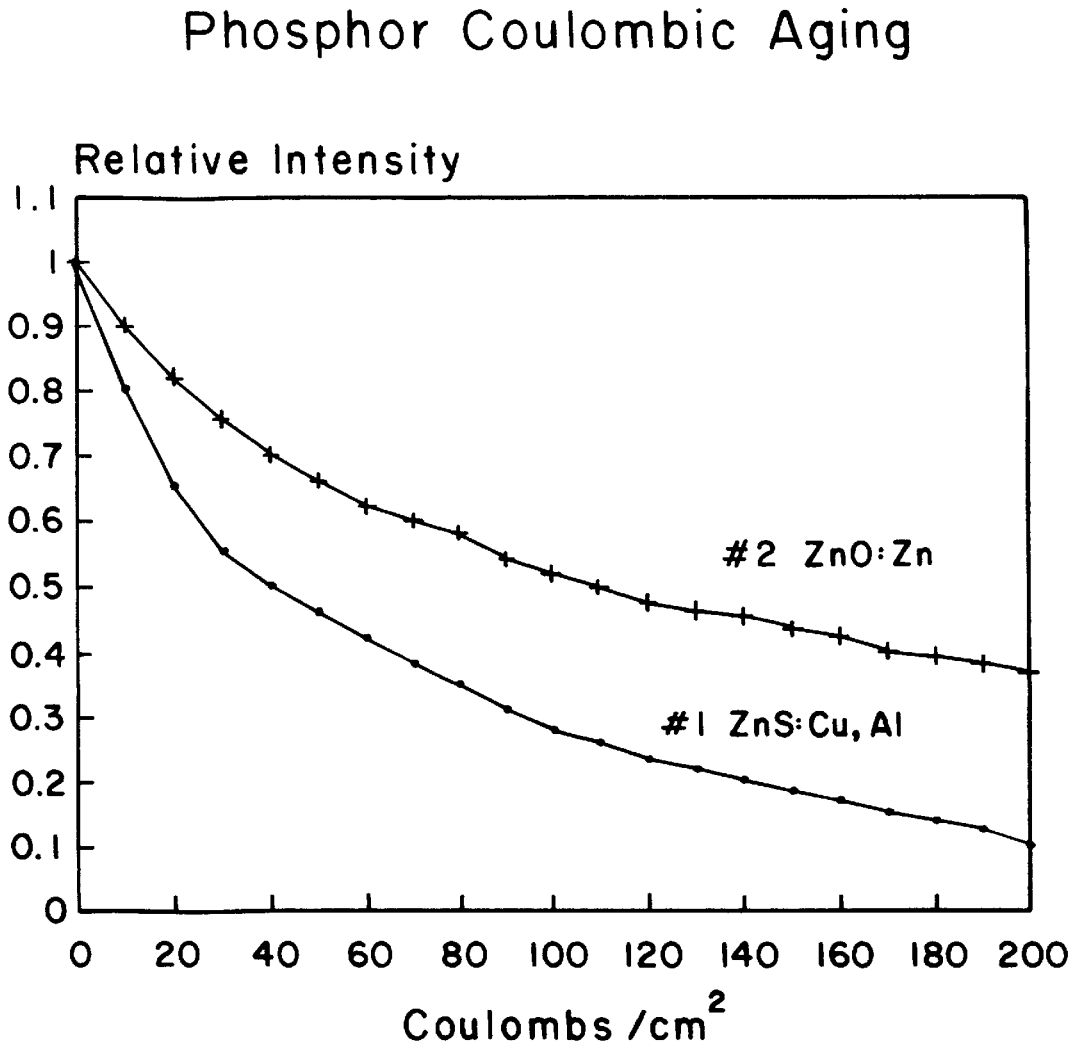
FIG. 7 illustrates graphically the Coulombic aging of ZnO:Zn and ZnS:Cu,Al phosphor screens in the absence of a secondary salt.

FIG. 7 illustrates the Coulombic aging and loss of efficiency of two phosphor screens prepared as described in Example 1 without a second salt. The two phosphor screens, a green ZnO:Zn screen and a green ZnS:Cu,Al screen, had a deposited phosphor film 6 microns thick that had been prepared from phosphor powders containing phosphor particles 2–3 microns in size. The Coulombic aging of the phosphors was measured by focusing an electron beam at the phosphor surface at 700 V and 10 mA/cm$^2$ in a vacuum at a base pressure of $1\times10^8$ torr. The light output was measured by a photometer and detected as photocurrent intensity. The change in photocurrent intensity with time was used as a measure for the change in phosphor efficiency with time. Curve #1 in FIG. 7 was obtained for a phosphor screen having a green ZnS:Cu,Al phosphor film. Curve #2 in FIG. 7 was obtained for a phosphor screen having a green ZnO:Zn phosphor. As seen from the graph in FIG. 7, the loss of 50% of the initial screen efficiency appeared to be around 40 Coulombs/cm$^2$ for the ZnS:Cu,Al screen; while the ZnO:Zn screen appeared to lose 50% of its initial efficiency at about 110 Coulombs/cm$^2$. Those experimental results coincide with the literature published data for Coulombic aging of ZnS and ZnO phosphors.

EXAMPLE 2

Preparation of Phosphor Screen Employing Cu $(NO_3)_2\times6H_2O$ as the Secondary Salt I. Preparation of the Phosphor Deposition Composition (per 100 ml.)

In a clean container, one gram of a commercially available phosphor, such as ZnS:Cu,Al powder, is suspended in isopropanol. The phosphor powder (preferably sieved through about a 250 mesh screen) is slowly added to approximately 100 ml of continuously stirred isopropanol. Then 0.05 gm $La(NO_3)_3\times6H_2O$, which is a $5\times10^{-4}$ M concentration of a 99.99% pure salt, is added to the stirred phosphor suspension. This preparation is continuously stirred for 30 min with a magnetic stirrer to allow the adsorption of the disassociated cation ($La^{+3}$) on the surface of the phosphor particles. Upon formation of the $La^{+3}$-charged phosphor particles, the charged phosphor particles are ultrasonically treated to break up phosphor particle agglomerates. Ultrasonic treatment is done by placing the mixture in an ultrasound bath, immersing a clean ultrasound horn into the suspension and subjecting the mixture to a fairly intense level of ultrasound (from about 40 to about 60 watts) for approximately 30 min as judged from the dispersion of the phosphor agglomerates.

The conductivity of the charged phosphor suspension is measured on a carefully standardized conductivity meter. The charged phosphor suspension conductivity is adjusted to fall between 5 and 10 $\mu$S/cm. If the conductivity of the suspension is less than 5 $\mu$S/cm, additional $La(NO_3)_3$ is added. If the conductivity of the suspension is greater than 10 $\mu$S/cm, isopropanol is added.

When the suspension has the appropriate conductivity, 0.05 M $Cu(NO_3)_2\times6H_2O$ is added to the charged phosphor solution to form the phosphor deposition composition. The phosphor deposition composition continues to be mixed thoroughly with a mechanical stirrer for about 30 min. The phosphor deposition composition is then ultrasonically treated for about 30 min as described above. The entire process of preparing the phosphor deposition composition is preferably done at room temperature. Although heating will accelerate the process, increased temperatures will also increase the evaporation rate of the solvent; therefore, increased temperatures are generally not employed.

Steps II and III are the same as described in Example 1.

EXAMPLE 3

Preparation of Phosphor Screen Employing Mg $(NO_3)_2\times6H_2O$ as the Secondary Salt A phosphor screen was prepared in the same manner as described for Example 2, except that the secondary salt added to the charged ZnS:Cu,Al suspension was $Mg(NO_3)_2\times6H_2O$, introduced at a concentration of 0.075 M.

EXAMPLE 4

Preparation of Phosphor Screen Employing $AgNO_3$ as the Secondary Salt

A phosphor screen was prepared in the same manner as described for Example 2, except that the secondary salt added to the charged ZnS:Cu,Al suspension was $AgNO_3$, introduced at a concentration of 0.03 M.

Figure 8:
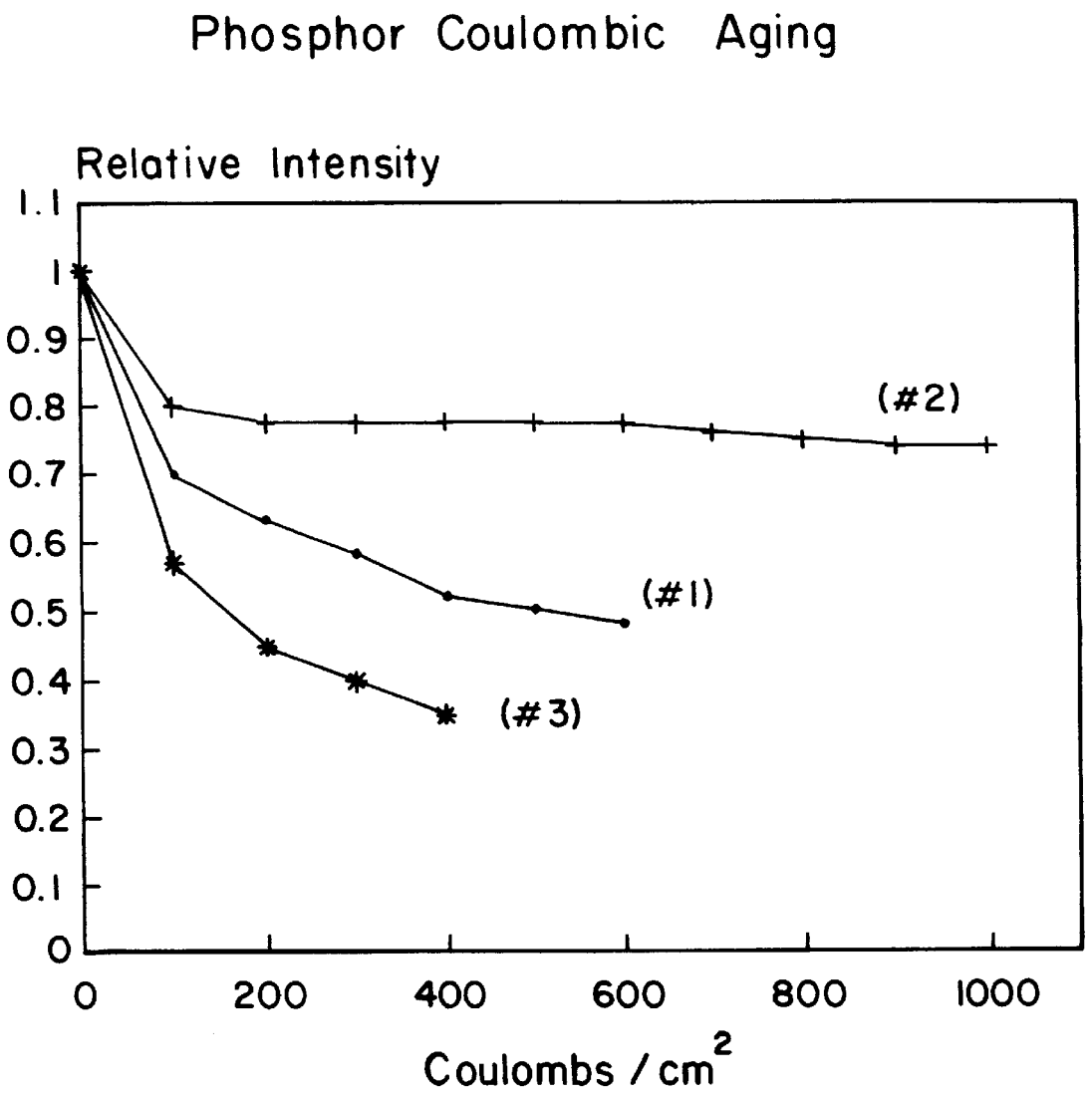
FIG. 8 illustrates graphically the Coulombic aging of ZnS:Cu,Al phosphor screens that were prepared with a secondary cation interspersed among the phosphor particles.

FIG. 8 illustrates the Coulombic aging and loss of efficiency of three phosphor screens prepared as described in Examples 2, 3 and 4 and tested in the same manner as described for the results obtained in FIG. 7. Examples 2, 3 and 4 describe the production of ZnS:Cu,Al phosphor screens wherein 0.05 M $Cu(NO_3)_2\times6H_2O$, 0.075 M $Mg(NO_3)_2\times6H_2O$, or 0.03 M $AgNO_3$ was used as the secondary salt.

Curve #1 in FIG. 8 was obtained for a ZnS:Cu,Al phosphor screen prepared with the secondary salt 0.05 M $Cu(NO_3)_2 \times 6H_2O$. Curve #1 indicates that the loss of 50% of the screen efficiency appeared to occur after about 500 Coulombs/$cm^2$.

Curve #2 in FIG. 8 was obtained for a ZnS:Cu,Al phosphor screen prepared with the secondary salt 0.075 M $Mg(NO_3)_2 \times 6H_2O$. Curve #2 shows that this screen had only lost about 75% of its screen efficiency after 1,000 Coulombs/$cm^2$.

Curve #3 in FIG. 8 was obtained for a ZnS:Cu,Al phosphor screen prepared using 0.03 M $AgNO_3$ as the secondary salt. Curve #3 indicates that this screen had lost 50% of its screen efficiency after about 100 Coulombs/$cm^2$.

The decrease in Coulombic aging of phosphor screens obtained when secondary cations were interspersed among charged phosphor particles was impressive when compared to the Coulombic aging of phosphor screens prepared without adding a secondary salt to the charged phosphor suspension as illustrated in Curve #1 of FIG. 7. Of the secondary salts tested $Mg(NO_3)_2 \times 6H_2O$ gave the best results (extending the life span of the phosphor screen more than 25 fold when compared to the screen that did have a secondary cation), $Cu(NO_3)_2 \times 6H_2O$ provided the next best results (extending the life span of the phosphor screen at least 12 fold), and the $AgNO_3$, although the least impressive of the three secondary salts tested, extended the life span of the phosphor screen by more than 100%.

EXAMPLE 5

Preparation of a Red Phosphor Screen Employing an $In_2O_3/SnO_2$ Mixture as the Secondary Salt A phosphor screen was prepared in the same manner as described in Example 2, except that the phosphor used to make the charged phosphor suspension was the red phosphor $Y_2O_2S$:Eu and the secondary salt solution added to that charged phosphor suspension was a 0.05 M solution that was 50% $In_2O_3$ and 50% $SnO_2$.

The Coulombic aging and loss of efficiency was measured for a $Y_2O_2S$:Eu phosphor screen that did not employ a secondary salt and for a $Y_2O_2S$:Eu screen that was prepared with a 50/50 mixture of $In_2O_3$ and $SnO_2$. No change in Coulombic aging was detected in the phosphor screen prepared with the $In_2O_3/SnO_2$ mixture as compared to the phosphor screen prepared without the mixture. However, the threshold voltage for the $Y_2O_2S$:Eu phosphor screen was reduced from 133 eV for the screen prepared without the $In_2O_3/SnO_2$ mixture to 40 eV for the screen prepared with the $In_2O_3/SnO_2$ mixture as reported in Table 1.

TABLE 1

THRESHOLD VOLTAGES OF STANDARD PHOSPHOR FILMS PREPARED WITH A SECONDARY SALT

| Phosphor-Color | Secondary Salt | Threshold (eV) |
|---|---|---|
| ZnS:Ag-Blue | none | 100 |
| ZnS:Ag-Blue | $In_2O_3/SnO_2$ | 30 |
| ZnS:Ag-Blue | ZnO (nonluminescent) | 13 |
| $Y_2O_2S$:Eu-Red | none | 130 |
| $Y_2O_2S$:Eu-Red | $In_2O_3/SnO_2$ | 40 |

EXAMPLE 6

Preparation of a Blue Phosphor Screen Employing an $In_2O_3/SnO_2$ Mixture as the Secondary Salt A phosphor screen was prepared in the same manner as described in Example 5, except that the phosphor used to make the charged phosphor suspension was a blue ZnS:Ag phosphor.

Although no difference was detected in the Coulombic aging between the ZnS:Ag phosphor screens prepared with and without a 50/50 mixture of $In_2O_3$ and $SnO_2$; a substantial drop in the threshold voltage was observed (i.e., 100 eV in the absence of an $In_2O_3/SnO_2$ versus 30 eV in the presence of the $In_2O_3/SnO_2$). See Table 1.

EXAMPLE 7

Preparation of a Phosphor Screen Employing a Nonluminescent ZnO as a Secondary Salt A phosphor screen was prepared in the same manner as described in Example 6, except that the secondary salt added to the charged ZnS:Ag phosphor suspension was nonluminescent ZnO.

Similar to the results in Example 6, the addition of a ZnO salt did not apparently alter the Coulombic aging of the ZnS:Ag phosphor screen, but it did decrease the threshold voltage of the phosphor screen from 100 eV in the absence of the ZnO to 13 eV in the presence of the ZnO.

Having described several embodiments of the phosphor compositions and the methods of deposition of the charged phosphor and secondary cation components of those compositions in accordance with the present invention, it is believed that other modifications, variations and changes will be suggested to those skilled in the art in view of the description set forth above. It is therefor to be understood that all such variations, modifications and changes are believed to fall within the scope of the invention as defined in the appended claims.

What is claimed is:

1. A process for producing a phosphor screen comprising the following steps in the sequence set forth;

preparing a phosphor deposition suspension, wherein said suspension comprises phosphor particles having first cations adsorbed to said phosphor particles to form a charged phosphor and second cations having a lower valence than said first cations and present at a concentration at least ten times the concentration of said first cations;

electrochemically depositing said charged phosphors and said second cations onto a conductive substrate to form a phosphor film on said substrate; and curing said phosphor film in an oxidizing atmosphere at a temperature greater than 350° C.

2. A process for producing a phosphor deposition suspension comprising the following steps in the sequence set forth:

adding a plurality of phosphor particles to a solution of a charging salt, the charging salt having first cations that are trivalent or tetravalent;

agitating the phosphor particles in the charging solution until a portion of the first cations are adsorbed to the surface of the phosphor particles to form a charged phosphor suspension;

adjusting the conductivity of the charged phosphor suspension from about 5 to about 10 $\mu$S/cm;

adding second cations to the charged phosphor suspension to form a phosphor deposition suspension, wherein an oxidative product of the second cations have a secondary electron emission ratio that is greater than 1.0;

wherein the second cations are added at a concentration that is at least ten times the concentration of the first cations; and wherein the second cations have a lower valence than the first cations.

3. The process of claim 2, wherein the first cations are tetravalent and the second cations are trivalent or bivalent.

4. The process of claim 2, wherein the first cations are trivalent and the second cations are bivalent.

5. The process of claim 2, wherein the oxidative product of second cations have a secondary electron emission ratio that is greater than or equal to 2.0.

6. A phosphor deposition suspension adapted for electrochemical deposition onto a conductive substrate, said suspension comprising:

a plurality of phosphor particles having first cations adsorbed thereto, the first cations being trivalent or tetravalent;

second cations wherein the second cations are present at a concentration that is at least ten times the concentration of the first cations; and wherein the second cations have a lower valence than the first cations.

7. The phosphor deposition suspension of claim 6, wherein the first cations are tetravalent and the second cations are trivalent or bivalent.

8. The phosphor deposition suspension of claim 6, wherein the first cations are trivalent and the second cations are bivalent.

9. The phosphor deposition suspension of claim 6, wherein an oxidative product of the second cations have a secondary electron emission ratio that is greater than 1.0.

10. The phosphor deposition suspension of claim 6, wherein the phosphor deposition suspension has a conductivity from about 5 to about 10 $\mu$S/cm.

11. The phosphor deposition suspension of claim 6, further comprising an alkanol having one to five carbons.

12. The phosphor deposition suspension of claim 6, wherein the phosphor particles include an effective amount of an activator suitable for imparting color to a phosphor screen.

13. The phosphor deposition suspension of claim 6, wherein the phosphor particles include a zinc sulfide phosphor.

* * * * *